350-394 SR
XR 4,020,336
TX 40420 CR

United Stat

Linder

[11] 4,020,336

[45] Apr. 26, 1977

[54] VEHICULAR FOG HEADLIGHT

[75] Inventor: Ernst Linder, Muhlacker, Germany

[73] Assignee: Robert Bosch G.m.b.H., Stuttgart, Germany

[22] Filed: Oct. 1, 1975

[21] Appl. No.: 618,415

[30] Foreign Application Priority Data

Oct. 24, 1974 Germany ..... 2450456

[52] U.S. Cl. ..... 240/9.5; 240/41.4 R; 350/152

[51] Int. Cl.[2] ..... F21V 9/00; F21M 3/04

[58] Field of Search ..... 240/9.5, 41.4 R, 1.2, 240/7.1 R, 46.01, 92; 350/147, 152, 154–156

[56] References Cited

UNITED STATES PATENTS 3,808,422 4/1974 Handtmann et al. ..... 240/9.5

*Primary Examiner*—Richard A. Wintercorn
*Attorney, Agent, or Firm*—Flynn & Frishauf

[57] ABSTRACT

To prevent scattering of projected light due to fog, the headlight is so constructed that at least that portion of the light projected in the distance (that is, not immediately in front of the vehicle and spread laterally) is polarized; thus, arrangements to prevent limitation of projected light to the region just above the path-way of the vehicle can be avoided.

9 Claims, 5 Drawing Figures

4020336
OR IN 362/19

VEHICULAR FOG HEADLIGHT

The present invention relates to headlights for vehicles, and more particularly to headlights for use under fog conditions, adapted, for example, to automotive use, although the invention is applicable to any type of light being projected under fog conditions.

Light projected from search lights, headlights of vehicles and the like, is reflected by the suspended moisture droplets present in fog. The effect on the observer is the formation of a nearly impenetrable veil. The reflected light may be so intense that it blinds the observer or vehicle operator himself.

Various types of fog headlights have been proposed; in one known type, shutters or directing flaps have been provided which are so arranged that as little light as possible is projected upwardly. Such a fog headlight provides illumination which is essentially directed downwardly, and spread out in front of the vehicle. The immediate area or region of the path-way in front of the vehicle is thus illuminated. The extent of projection of light forwardly from the vehicle is severely limited, however.

It is an object of the present invention to provide an improved fog headlight which provides good visibility for the vehicle operator.

Subject matter of the present invention: Briefly, limitation of projected light to the region immediately in advance of the vehicle, and directed downwardly, is omitted; the portion of the light directed forwardly and providing distance illumination ahead of the vehicle is a polarized light beam.

Moisture droplets in fog cause much less depolarization of the polarized light projected by the fog headlight of the present invention than the path-way surface, such as a road surface, a track-way, or the like. If the operator is provided with an analyzer, or polarized lenses having a polarization plane which is rotated by 90° with respect to the plane of polarization of the projected light, then the reflected light from the fog moisture droplets, which is only slightly depolarized, is effectively cancelled in the analyzer, or polarized glasses or lenses; the highly depolarized light which is reflected from the path-way, road, track-way, or the like is, however, passed by the analyzer. Unpolarized light reaching the road-way, for example from road illumination and reflected by the path-way, is also passed by the analyzer.

The invention will be described by way of example with reference to the accompanying drawings, wherein.

Figure 1:
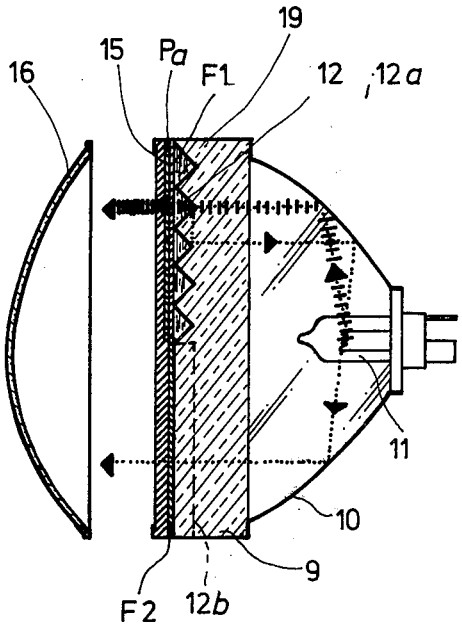
FIG. 1 is a schematic vertical cross-sectional view of an automotive fog headlight.

A parabolic reflector 10 (FIG. 1) has a light source 11 at the focal point thereof, schematically indicated as an incandescent filament. An interference polarizer 12 is located at the outer end of reflector 10. The interference polarizer, which may also be a layered polarizer, is stepped or ribbed, to have sawtooth cross section, as shown in exaggerated form in FIG. 1. The sawtooth or rib surfaces have an inclination of ±45° with respect to the optical axis. The interference polarizer 12 is evaporated on a glass support 9, which is formed with the ribbed surfaces, and has a smooth surface at the other side. The smooth surface at the other side of glass disk 9 is perpendicular to the optical axis. The upper half 12*a* of the interference polarizer 12 is ribbed in the horizontal direction; the lower half 12*b* is ribbed in the vertical direction, as is clearly apparent in FIG. 2. Two semi-circular $\lambda/2$ foils $F_1$ and $F_2$ are located downstream — with respect to the direction of emitted light — of the interference polarizer 12. Foil $F_1$ covers the upper half 12*a* of the interference polarizer 12. The space between the foils $F_1$, $F_2$ and the interference polarizer 12 is filled with an immersion liquid 19. An absorption filter $P_a$ is located above the upper half 12*a* of the interference polarizer 12 to eliminate any stray, unpolarized radiation which may have passed through the interference polarizer 12. The lower half of the headlight, that is, the half formed by the interference polarizer 12b, provides light directed essentially immediately in front of the vehicle and need not have any additional polarization filters; the pre-polarized light passing through the interference polarizer half 12b need not be additionally polarized.

A glass cover 15 covers the entire system. The glass cover 15 is slightly thicker in its lower half by the thickness of the filter $P_a$ so that the space taken up by the absorption polarizing filter $P_a$, which covers only the upper half, is taken up by the glass at the lower half. A lens 16 is placed in front of the entire assembly.

Figure 2:
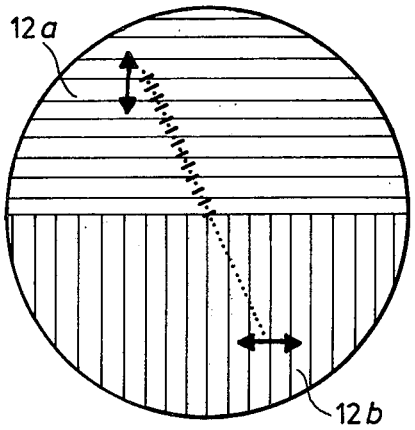
FIG. 2 is a front view of the headlight with the cover lens omitted.

Operation, with reference to FIGS. 1 and 2: A light beam has been symbolically illustrated in FIGS. 1 and 2, to explain the operation. A light beam projected, for example, upwardly and to the left from source 11, first impinges the parabolic mirror 10 and is reflected by the parabolic mirror in the direction of the optical axis. Half of the beam is passed by the horizontally ribbed upper half 12*a* of the interference polarizer 12; half of the light is reflected. The reflected light impinges again on the interference polarizer 12, is reflected again, and is then reflected in the direction of the optical axis on the mirror reflector 10. After reflection on mirror 10, it again passes through the focal point of the reflector 10 and then impinges on the vertically ribbed lower half 12*b* of the interference polarizer 12. Since the beam is horizontally polarized, it is passed in its entirety by the lower half 12*b* of the interference polarizer 12. Thus, light passing from the lower half of the interference polarizer 12 is horizontally polarized; light passing through the upper half 12a of the interference polarizer 12 is polarized in vertical direction, as indicated schematically in FIG. 2 by the double arrows. The polarization direction of the light from the interference polarizer 12 is rotated by the ½ foils $F_1$ and $F_2$, which are so oriented that the polarization direction of the light from the two halves 12*a*, 12*b* of the interference polarizer 12 are rotated in the same direction, namely by 45° with respect to the horizontal. The subsequently placed polarization filter foil $P_a$ increases the polarization effect of that light which is derived from the upper half 12*a* of the interference polarizer 12.

Figure 3:
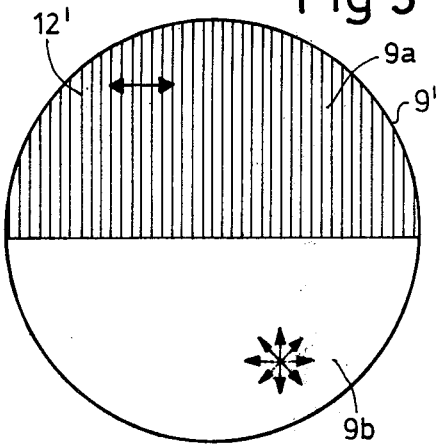
FIG. 3 is a front view of another embodiment of a headlight for automotive vehicles.
Figure 4:
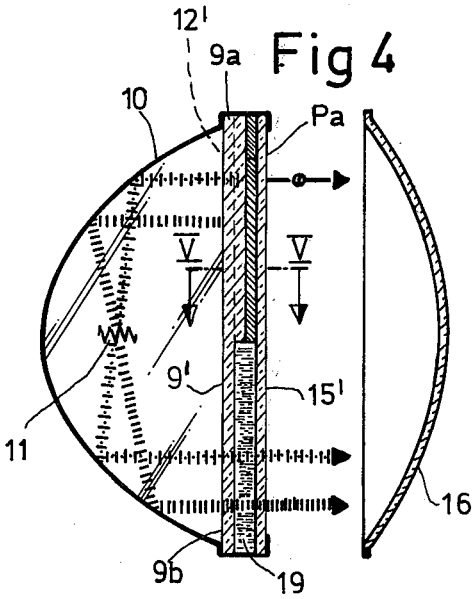
FIG. 4 is a cross-sectional longitudinal view of the headlight of FIG. 3.
Figure 5:
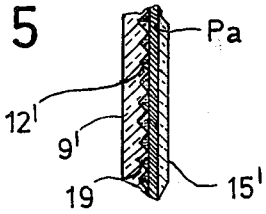
FIG. 5 is a fragmentary sectional view along lines V—V of FIG. 4.

FIGS. 3 to 5 illustrate another embodiment of the invention, applied to an automotive headlight. The light source 11 is only schematically shown as an incandescent filament. The interference polarizer 12', which is vertically ribbed, extends only over the upper half of the parabolic reflector 10. The ribbing is in vertical direction, so that only the upper half 9*a* of the glass block 9' is ribbed. The lower half 9*b* of the glass disk 9' is flat on both surfaces. An absorption polarizing filter $P_a$ follows the interference polarizer 12', which extends only over the upper half of the headlight. The free space in advance of glass disk 9' which arises due to the ribbing, and the absorption polarizing filter $P_a$ are filled with immersion liquid 19, which is necessary, in any event, for the upper half of the headlight to fill the space between ribs. Glass cover disk 15' is flat on both sides and has the same thickness throughout.

Only the upper half of the light from the headlight is polarized in the embodiment of FIGS. 3 to 5. The light derived from the lower half of the headlight is not polarized at all. Interference polarizer 12' and absorption polarizing filter $P_a$ are so oriented that linearly polarized light is emitted from the headlight which has a horizontal direction of polarization. A rotator foil, that is, a $\lambda/2$ foil to rotate the polarization direction, can thus be omitted, if horizontally polarized light is suitable.

The arrangement in accordance with FIGS. 1 and 2 can be modified to also provide horizontally polarized light. Two $\lambda/2$ foils must then be used in the upper half of the headlight, corresponding to the half 12*a* of the interference polarizer 12', in order to rotate the direction of polarization twice by +45°, In the lower half, the $\lambda/2$ foil is then omitted. No absorption polarization filter for the lower half is necessary in such an arrangement either, whereas an absorption polarization filter $P_a$ is desirable for the upper half to increase the degree of polarization.

The reflector is preferably a body of rotation and has a circular outline, as seen in FIGS. 2 and 4. This is not strictly necessary, however.

Various changes and modifications may be made within the scope of the inventive concept.

I claim:

1. Vehicular fog headlight comprising a reflector (10) and a light source (11) located at least approximately at the focal point of the reflector to project light ahead of the vehicle and providing a distance beam directed to illuminate the region substantially in advance of the vehicle; wherein means are provided to direct light emanating from the lower half of the reflector immediately ahead of the vehicle; the distance beam is derived from the upper half of the reflector; and polarization means are provided polarizing at least the part of the light projected from the upper half and forming said distance beam.

2. Headlight according to claim 1, wherein the polarization means comprises a stepped, ribbed interference polarizer (12) having sawtooth-shaped ribs with inclined rib surfaces which have an angle of inclination of about ± 45° with respect to the optical axis of the reflector.

3. Headlight according to claim 2 wherein (FIGS. 1 and 2) the reflector (10) is parabolic;

the interference polarizer (12) comprises two half sections (12*a*, 12*b*), one half section (12*a*) covering the upper half of the light projection opening and the other half section (12*b*) covering the lower half of the light projection opening;

the ribbing of the upper half (12*a*) extends parallel to the separation line between said halves, the ribbing of the lower half (12*b*) extending at right angles to the ribbing of the upper half;

and at least one $\lambda/2$ polarization rotating foil ($F_1$, $F_2$) is provided, located behind — in the direction of projection of light — of a ribbed half and extending essentially over said half, the foil rotating the light components reflected by the interference polarizer and rereflected by the reflector by ± 45°.

4. Headlight according to claim 3, wherein the reflector (10) is a circular parabolic reflector and two foils are provided which are essentially semi-circular.

5. Headlight according to claim 3, wherein the separation line of the interference polarizer (12) between said halves (12*a*, 12*b*) extends essentially horizontally.

6. Headlight according to claim 2, further comprising an absorption polarizing filter ($P_a$) located behind the interference polarizer (12) and covering the upper half (12*a*) of the polarizer to enhance the polarization effect of said beam.

7. Headlight according to claim 2, wherein (FIGS. 3 to 5) the ribbed interference polarizer extends only over the upper half of the reflector (10).

8. Headlight according to claim 7, wherein the ribbing of the interference polarizer (12') extends vertically.

9. Headlight according to claim 2, further comprising a covering pane (15) located opposite the ribbing of the interference polarizer, and an immersion liquid (19) filling the space between said pane and the interference polarizer and the space between the ribs thereof.

* * * * *